United States Patent [19]

Smick

[11] 4,044,796

[45] Aug. 30, 1977

[54] TURBULATOR

[76] Inventor: Ronald H. Smick, 745 Chapel St., Ottawa, Ill. 61350

[21] Appl. No.: 656,329

[22] Filed: Feb. 9, 1976

[51] Int. Cl.[2] ..... B01F 15/06; F15D 1/02

[52] U.S. Cl. ..... 138/38; 110/97 D; 122/155 A; 165/179; 259/4 R

[58] Field of Search ..... 110/97 D; 122/155 A; 138/37, 38, 39; 165/177, 179, 181, 184; 259/4 R; 302/64

[56] References Cited

U.S. PATENT DOCUMENTS

| | | | |
|---|---|---|---|
| 2,640,194 | 5/1953 | Hytte | 138/38 X |
| 2,660,198 | 11/1953 | Morrow | 138/38 |
| 3,185,143 | 5/1965 | Wilson | 138/38 X |

*Primary Examiner*—Richard E. Aegerter
*Assistant Examiner*—Frederick R. Schmidt
*Attorney, Agent, or Firm*—Leydig, Voit, Osann, Mayer & Holt, Ltd.

[57] ABSTRACT

A turbulator formed of a strip of metal into a series of alternating deflection panels successively joined together by bridging sections with the deflection panels along the length of the strip alternately angling back and forth and simultaneously tilting up and down relative to the turbulator axis is provided to mix and substantially uniformly direct hot flue gases and the like against the internal walls of a fire tube.

9 Claims, 8 Drawing Figures

TURBULATOR

The present invention relates to flue gas turbulators and more particularly concerns an improved turbulator capable of mixing and directing a heating fluid, such as flue gas, substantially completely and uniformly against the internal walls of a heat exchanger conduit such as a fire tube or the like.

Since at least about the turn of the century, various baffles or diverters have been proposed for installation in boiler fire tubes and the like for diverting the hot flue gases against the side walls of boiler fire tubes. One approach, as shown in U.S. Pat. Nos. 1,056,373 (FIG. 1), 2,091,274, 2,691,991 and 2,852,042 has been to insert in the fire tube an essentially flat, longitudinally extending strip of metal having a plurality of tabs, tongues or ears struck from the web of the strip and bent to project at alternating angles so as to divert a portion of the flue gas back and forth across the width of the fire tube.

Another approach has been to twist the strip into a spiral and also to provide it with various deflecting ears or lobes to create a swirling turbulent flow within the flue tube. (See U.S. Pat. Nos. 1,056,373 FIG. 2, 1,272,113, 1,961,744 and 2,865,405) Yet another approach has been to provide an essentially flat strip of metal with a series of undulating bends with (see U.S. Pat. Nos. 2,161,887 and 2,591,398 FIGS. 1–3) or without (see U.S. Pat. Nos. 1,948,064, 2,660,198 and 2,591,398 FIG. 4) projecting ears.

In the main, however, these former devices have tended to stratify the hot gases on opposite sides of the flat strips, to centrifuge the cooler more dense gases out along the edges of the spiral strips or, due to the tab size or width of the undulating strips, to cause too great a flow restriction in the flue tube.

With regard to the latter problem, perhaps the most commercially successful turbulator to date has been one patterned after the embodiment shown in FIG. 4 of Brock U.S. Pat. No. 2,591,398 but with the strip width reduced by half or more and the tilt angle (see Col. 3, 11. 38–42) changed to about 45°. Such turbulators, or zig-zag baffles are shown as applied in space heater applications in U.S. Pat. Nos. 3,185,143 and 3,359,964. While such "Brock" turbulators have been effective in improving the heat transfer of flue gases and other heating fluids to the walls of fire tubes and the like, they tend to direct the hot fluid against only one-half of the circumference of the tube (e.g. "downwardly" as indicated at Col. 3, 1. 42).

Accordingly, it is the primary aim of the present invention to provide an improved turbulator which is effective in mixing and directing hot flue gases substantially completely and uniformly around the internal walls of a fire tube or the like.

It is a more specific object to provide such an improved turbulator which achieves substantially uniform wall contact of the hot gases with a minimum amount of flow restriction.

Another object of the invention is to provide an improved turbulator of the above type which may be installed in a fire tube without regard to the rotational orientation of the turbulator about its axis.

A further and more detailed object of the present invention is to provide an improved turbulator of the foregoing type without the formation of sharp contact points that cause wear and etching on the inside surfaces of the fire tubes.

These and other objects and advantages of the invention will become more readily apparent upon reading the following detailed description and upon reference to the accompanying drawings, in which:

FIG. 1 is a fragmentary horizontal sectional view of an exemplary fire tube with the improved turbulator of the present invention illustrated therein in plan view;

FIGS. 2 and 3, respectively, are vertical side and end sectional views taken substantially along lines 2—2 and 3—3 in FIG. 1;

While the present invention will be described in connection with certain preferred embodiments and procedures, it will be understood that I do not intend to limit the invention to those particular embodiments or procedures. On the contrary, I intend to cover all alternatives, modifications and equivalents as may be included within the spirit and scope of the invention as defined by the appended claims.

Figure 1:
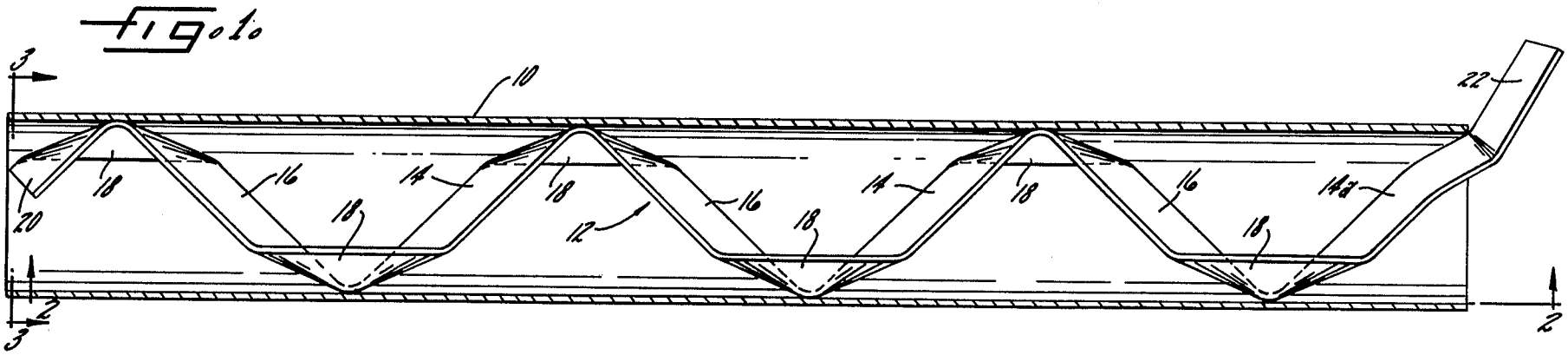
Figure 2:
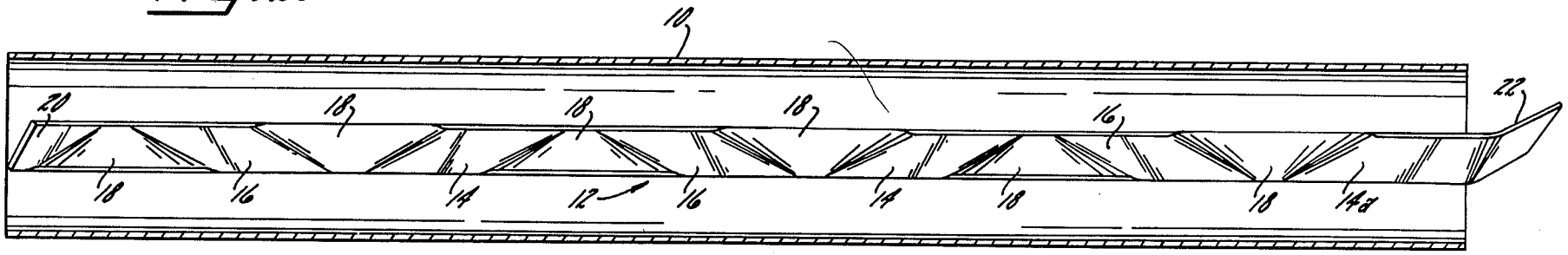
Figure 3:
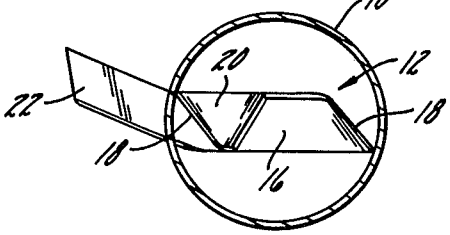

Turning now to the drawings, there is shown in FIGS. 1, 2 and 3 an exemplary fire tube 10 in which the improved turbulator 12 of the present invention is disposed. While the illustrated fire tube 10 is circular in cross section it will be understood that it could be square, rectangular or, indeed, any other closed geometric shape. Moreover, although the term fire tube is used herein, it is intended to broadly refer to any heat exchanger tube in which one heat exchanger fluid flows through the inside of the tube and another fluid flows over the outside of the tube. Likewise, when the term flue gas is used it should be understood broadly to encompass other heat exchanger mediums that could be either liquid, gas or a mixture thereof such as steam.

In accordance with the present invention, the improved turbulator 12 is formed from an elongated strip of metal into a series of alternating deflection panels 14 and 16 successively joined together by substantially triangular bridging portions 18. As shown in FIGS. 1–3, the turbulator 12 may have a partial panel 20 at one end and, preferably, has a projecting handle 22 at the other end. It will also be seen in FIG. 1 that the turbulator 12 is sized so that the deflection panels 14, 16 extend substantially completely across the width of the fire tube 10 and that the bridging portions 18 are disposed laterally of the axis of the turbulator 12.

Pursuant to the present invention, the deflection panels 14, 16 alternately angle back and forth and simultaneously tilt up and down, respectively, relative to the axis of the turbulator 12. Thus, as seen in FIGS. 1 and 2, and assuming the direction of flow of flue gases in the fire tube 10 is from left to right, deflection panels 14 direct the flue gases up and toward one side of the fire tube 10 and deflection panels 16 direct the flue gases down and to the other side of the fire tube. This alternate angling and tilting of the deflection panels 14, 16 not only thoroughly mixes the flue gases but, more importantly, directs the flue gases substantially completely and uniformly against the internal walls of the fire tube 10. As those skilled in the art will appreciate this greatly improves the heat exchanger efficiency of the turbulator 12-fire tube 10 combination over those prior designs which direct the flue gases only over about one-half of the fire tube surface. Greater efficiency, of course, also means a reduction in fuel costs.

Another advantage of the improved turbulator of the present invention is that since the alternate angling and tilting of the deflection baffles 14, 16 directs the flue gases around 360° of the internal surface of the fire tube 10, the turbulator may be installed in the fire tube without particular regard to its rotational orientation about its axis. This not only simplifies the initial installation but also eliminates expensive service calls which have arisen in the past when the prior unidirectional tubulators have been misoriented.

As noted above, the improved turbulator 12 preferably includes a handle portion 22 which extends out of the end of the fire tube 10. When it is desired to remove the turbulator 12 from the fire tube it is only necessary to pull the handle 22 to the right as seen in FIG. 1 and FIG. 2. The last deflection panel 14*a* adjacent the hande 22 is also dimensioned somewhat longer than the other panels 14, 16. Thus, as shown in FIG. 1 the last panel 14*a* engages and is biased against the edge of the fire tube 10 when the turbulator 12 is fully inserted. This effectively holds the turbulator 12 in place in the fire tube and prevents rattling which might otherwise occur.

Figure 4:
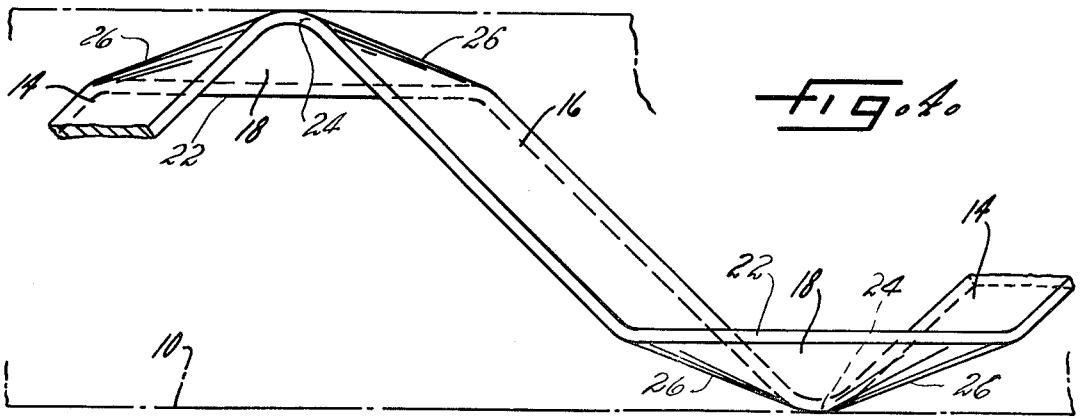
FIG. 4 is an enlarged fragmentary plan view of one portion of the turbulator shown in FIG. 1 and of the central segment of the turbulator shown in FIG. 6.

In the embodiment shown in FIGS. 1–3, all of the panels 14, 16 tilt at approximately 45° to the axis of the turbulator 12, it being understood that the panels 14 tilt up and forwardly whereas the panels 16 tilt down and forwardly with respect to the axis. For clarity, an enlarged view of one of the panels 16, two of the triangular bridging portions 18 and parts of two of the panels 14 is shown in FIG. 4. It will also be noted that each of the triangular bridging portions 18 is also tilted about 45° so that its base section 22 is closer to the turbulator axis than is its apex 24. As those skilled in the art will appreciate, it is the formation of these substantially triangular bridging portions 18 and the merging of the panels 14 and 16 into the legs 26 thereof which effects the alternate tilting of the panels 14, 16 while they also angle back and forth across the fire tube, in this case at an angle of about 45° to the axis of the turbulator.

It is important that the turbulator 12 not occupy too great a portion of the cross section of the fire tube 10 or it will create an excessive flow restriction. I have found that an efficient turbulator 12 results when the width of the strip of metal times the width or diameter of the fire tube is equal to about 30% of the cross sectional area of the fire tube. It will be appreciated, of course, that due to the tilt of the panels 14, 16 their effective frontal area is less. With a strip of the foregoing width and a panel tilt of about 45° the effective area of each panel is about 20% of the cross sectional area of the fire tube (see FIG. 3).

The length of the turbulator 12 may be substantially the same length as the fire tube 10 or it may be shorter. It will also be understood that where there is a vertical array of fire tubes 10, longer turbulators can be installed in the top tubes and shorter turbulators in the lower tubes to balance the heat load. This arrangement has been commonly employed with the prior "Brock" type turbulators (see e.g. FIG. 1 of U.S. Pat. No. 3,185,143) and is not per se part of the present invention.

Figures 5, 6, 7, 8:
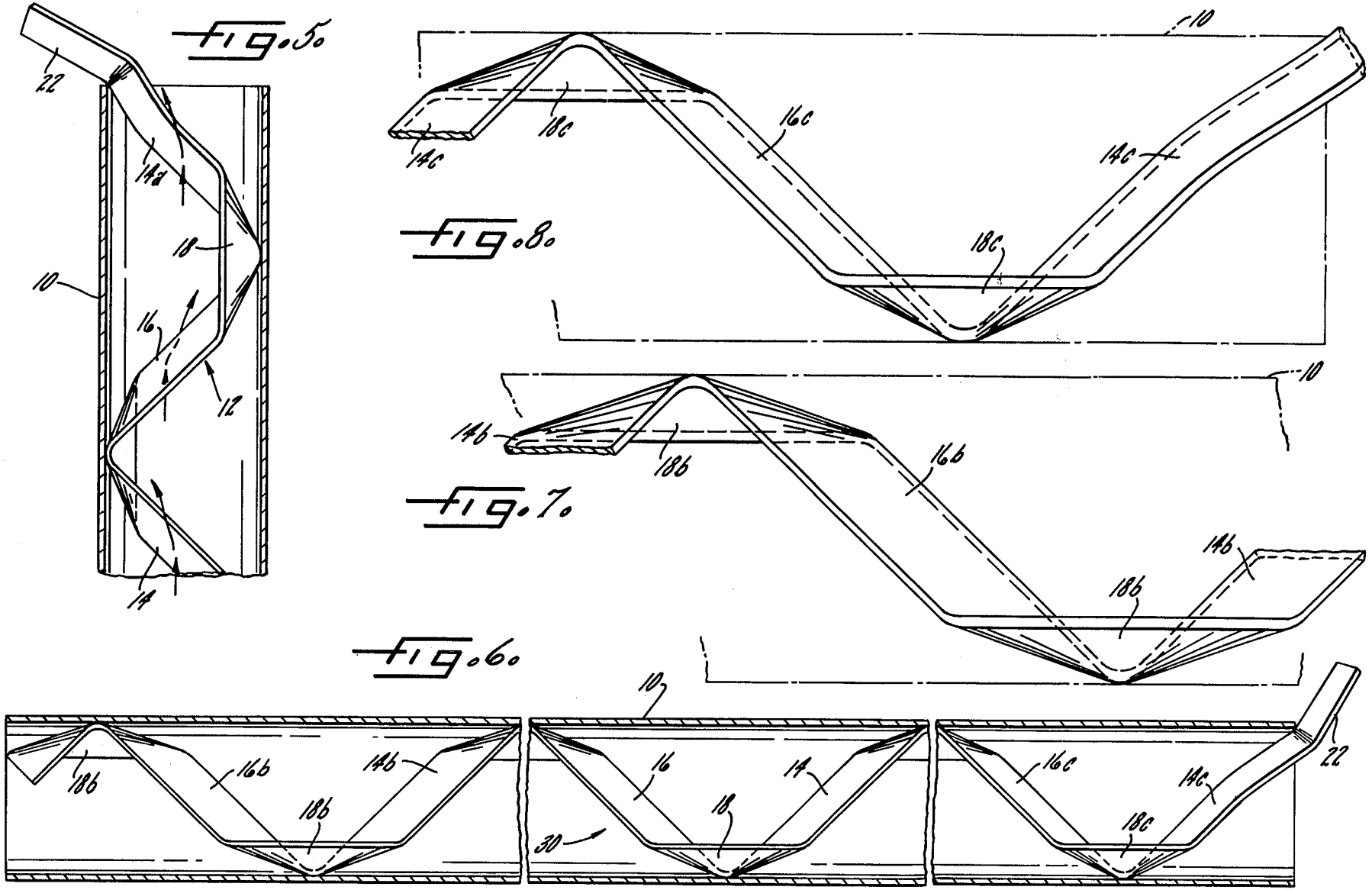
FIG. 5 is a fragmentary sectional view of a fire tube with the improved turbulator of the present invention disposed vertically therein and illustrated in side elevation.
FIG. 6 is a fragmentary sectional view, similar to FIG. 1, with a modified form of the turbulator of the present invention illustrated therein in three segments each having a different tilt angle relative to the horizontal; and, FIGS. 7 and 8, respectively, are enlarged fragmentary plan views, similar to FIG. 4 of the left and right-hand segments of the modified turbulator shown in FIG. 6.

Because the flue gases are directed around 360° by the turbulator 12, it may also be employed to advantage in vertically oriented fire tubes. A portion of such a vertical fire tube with one of the improved turbulators 12 is shown in FIG. 5. The turbulator 12 here is otherwise the same as shown in FIGS. 1–3.

In accordance with another aspect of the present invention the tilt angle of the deflection panels may be varied from relatively shallow at the entrance end of the turbulator to relatively steep adjacent the exit end. When the hot gases enter the fire tube the gas substantially fills the tube and only moderate mixing and small deflection is required to insure that the gas heats the internal surface of the tube. However, as the gas flows along in the fire tube it looses heat to the tube and contracts. Progressively more mixing and deflection is now required to direct the gas against the tube walls.

Three sections of such a modified turbulator 30 are shown in FIG. 6. In the center section, the deflection panels 14 and 16 are disposed with the same 45° tilt angle as in FIGS. 1–4. In the left-hand or entrance section, the deflection panels 14*b,* 16*b* have a tilt angle of about 30° relative to the turbulator axis and in the right-hand section, the tilt angle of the panels 14*c,* 16*c* is about 60° relative to the axis. Reference may be made to FIG. 4 for an enlarged view of the panel 16 and portions of the panels 14 in the center section of FIG. 6. FIGS. 7 and 8 are similarly enlarged fragmentary views of the left-hand and right-hand sections of the turbulator shown in FIG. 6 and more clearly illustrate the difference in tilt angle of the panels 14*b,* 16*b* and 14*c,* 16*c.*

The modified turbulator embodiment shown in FIG. 6 has been found to be particularly effective in uniformly distributing the flue gases to the internal walls of the fire tubes in older, low draft boilers. It will be appreciated, of course, that while only one pair of panels 14, 16 is shown in each of the three sections of FIG. 6, that in practice there will be a plurality of panels 14*b,* 16*b* having a tilt angle of about 30° to the turbulator axis, followed by a plurality of panels 14, 16 having a 45° tilt and then a section of panels 14*c,* 16*c* tilted about 60° to the turbulator axis.

I claim as my invention:

1. An improved turbulator for insertion in a heat exchanger conduit having substantially straight longitudinal internal walls, comprising, an elongated strip of metal formed into a series of alternating deflection panels successively joined together by substantially triangular bridging portions each having a pair legs forming an apex disposed laterally of the axis of said turbulator and joined to a base substantially parallel to said axis with said deflection panels along the length of said strip merging into the legs of said triangular portions while alternately angling back and forth and simultaneously tilting up and down relative to said axis for mixing and directing heat exchanger fluid flowing within said conduit substantially completely circumferentially and uniformly against the internal walls of said conduit.

2. An improved turbulator as defined in claim 1 wherein said alternating deflection panels are disposed substantially at right angles to one another and alternately tilt up and down relative to said axis in the range of from about 30° to about 60°.

3. An improved turbulator as defined in claim 2 wherein said tilt angle is substantially 45°.

4. An improved turbulator as defined in claim 2 wherein said tilt angle of said panels changes from about 30° to about 60° from the upstream to the downstream end of said turbulator along the direction of flow of said heat exchanger fluid.

5. An improved turbulator as defined in claim 4 wherein said panels are arranged in three successive groups along the direction of flow of said heat exchanger fluid with the first group having a tilt angle of about 30°, the second group having a tilt angle of about 45° and a third group having a tilt angle of about 60° relative to said axis.

6. An improved turbulator as defined in claim 1 wherein the width of said strip times the width of said conduit is equal to about 30% of the cross sectional area of said conduit.

7. An improved turbulator as defined in claim 1 wherein each of said panels due to its tilt presents an effective area of about 20% of the cross sectional area of said conduit.

8. An improved turbulator as defined in claim 1 wherein said triangular bridging portions are each tilted inwardly with the base thereof closer to said axis than the apex thereof.

9. An improved turbulator as defined in claim 1 including a handle portion adapted to project out of the end of said conduit and bent out of the plane defined by the adjacent deflection panel with the latter being dimensioned to be biased against the wall of said conduit.

* * * * *